US011665799B2

(12) United States Patent
Sun et al.

(10) Patent No.: US 11,665,799 B2
(45) **Date of Patent: *May 30, 2023**

(54) DIMMING MODE DETECTION CIRCUIT, DIMMING MODE DETECTION METHOD, NON-DIMMING MODE DETECTION CIRCUIT AND LED LIGHTING SYSTEM

(71) Applicant: Silergy Semiconductor Technology (Hangzhou) LTD, Hangzhou (CN)

(72) Inventors: Xiaohua Sun, Hangzhou (CN); Hao Chen, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/829,606

(22) Filed: Jun. 1, 2022

(65) Prior Publication Data

US 2022/0295615 A1 Sep. 15, 2022

Related U.S. Application Data

(63) Continuation of application No. 17/209,521, filed on Mar. 23, 2021, now Pat. No. 11,382,196.

(30) Foreign Application Priority Data

Apr. 2, 2020 (CN) ..... 202010256638.7

(51) Int. Cl.
*H05B 45/30* (2020.01)
*H05B 45/31* (2020.01)

(52) U.S. Cl.
CPC ..... *H05B 45/30* (2020.01)

(58) Field of Classification Search
CPC ..... H05B 45/31; H05B 45/357; H05B 45/37; H05B 45/3725; H05B 45/3575; H05B 47/16; H05B 47/165; H05B 47/17; H05B 45/30
See application file for complete search history.

(56) References Cited

U.S. PATENT DOCUMENTS

| | | | |
|---|---|---|---|
| 7,227,277 | B2 | 6/2007 | Chapman et al. |
| 7,256,568 | B2 | 8/2007 | Lam et al. |
| 8,222,832 | B2 | 7/2012 | Zheng et al. |
| 8,310,846 | B2 | 11/2012 | Piazzesi |
| 8,853,888 | B2 | 10/2014 | Khaligh |
| 9,130,460 | B2 | 9/2015 | Sun et al. |

(Continued)

*Primary Examiner* — Thai Pham

(57) ABSTRACT

A dimming mode detection circuit for an LED lighting system that receives an alternating current input voltage and generates a bus voltage to drive an LED load, the dimming mode detection circuit including: a leading edge detection circuit configured to generate a leading edge detection signal by detecting a leading edge of a first voltage representative of the bus voltage in one sine half-wave cycle, in order to determine whether the LED lighting system operates in a leading edge dimming mode; and a trailing edge detection circuit configured to generate a trailing edge detection signal in accordance with a time length of a first interval from a first value of the first voltage in a previous sine half-wave cycle to a second value of the first voltage in a next sine half-wave cycle, in order to determine whether the LED lighting system operates in a trailing edge dimming mode.

13 Claims, 12 Drawing Sheets

(56) References Cited

U.S. PATENT DOCUMENTS

| | | | | |
|---|---|---|---|---|
| 9,257,916 | B2 | 2/2016 | Cheng et al. | |
| 9,282,610 | B2 | 3/2016 | Kuang et al. | |
| 9,543,822 | B2 | 1/2017 | Hang et al. | |
| 9,559,591 | B2 | 1/2017 | Hang et al. | |
| 2007/0052397 | A1 | 3/2007 | Thompson et al. | |
| 2008/0231115 | A1 | 9/2008 | Cho et al. | |
| 2008/0258688 | A1 | 10/2008 | Hussain et al. | |
| 2012/0153729 | A1 | 6/2012 | Song et al. | |
| 2013/0063180 | A1 | 3/2013 | Sun et al. | |
| 2015/0078045 | A1 | 3/2015 | Zhang et al. | |
| 2015/0366019 | A1* | 12/2015 | Kuang | H05B 45/10 315/206 |
| 2016/0211745 | A1 | 7/2016 | Hang et al. | |
| 2017/0063238 | A1 | 3/2017 | Hang et al. | |
| 2017/0279279 | A1 | 9/2017 | Shimada et al. | |
| 2018/0198361 | A1 | 7/2018 | Seong et al. | |
| 2019/0150240 | A1* | 5/2019 | Yu | G01R 31/44 315/200 R |
| 2021/0068228 | A1* | 3/2021 | Yu | H05B 45/10 |
| 2021/0214375 | A1* | 7/2021 | Grice | C07D 211/58 |

* cited by examiner

DIMMING MODE DETECTION CIRCUIT, DIMMING MODE DETECTION METHOD, NON-DIMMING MODE DETECTION CIRCUIT AND LED LIGHTING SYSTEM

RELATED APPLICATIONS

This application is a continuation of the following application, U.S. patent application Ser. No. 17/209,521, filed on Mar. 23, 2021, and which is hereby incorporated by reference as if it is set forth in full in this specification, and which also claims the benefit of Chinese Patent Application No. 202010256638.7, filed on Apr. 2, 2020, which is incorporated herein by reference in its entirety.

FIELD OF THE INVENTION

The present invention generally relates to the field of power electronics, and more particularly to dimming mode detection circuits and methods, non-dimming mode detection circuits, and LED lighting systems.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Figure 1:
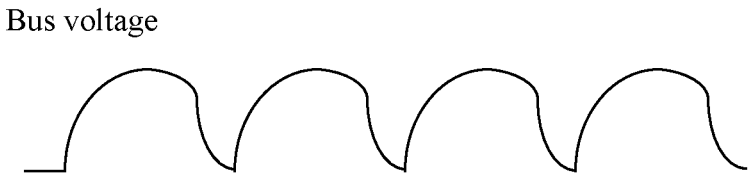
FIG. 1 is a waveform diagram of an example operation of the lighting system with a trailing edge dimmer.

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Because light-emitting diode (LED) has characteristics of high efficiency and energy saving, LED lighting has been widely used to replace traditional incandescent lamps and fluorescent lamps. For LED lighting systems with a triode alternating current (TRIAC) dimmer, three common dimming methods are utilized: leading edge dimming mode, trailing edge dimming mode, and non-dimming mode. Due to characteristics of the TRIAC dimmer itself, a holding current is a minimum main current required to keep the TRIAC dimmer in an on-state. Therefore, a bleeder circuit can be suitable for a TRIAC dimmer in LED lighting systems. When a current provided in the main loop is less than the holding current of the TRIAC dimmer, the bleeder circuit can provide additional current to maintain the on-state of the TRIAC dimmer. Due to different operation principles of the three dimming modes, the required bleeder current in the three modes is different, such that the operation state of the bleeder circuit is different. If the dimming mode is detected, the operation state of the bleeder circuit can be controlled, so a detection method for the dimming mode is important.

A typical lighting system includes a rectifier which receives an alternating current (AC) input voltage to generate a bus voltage along the DC bus to a DC/DC power converter. The DC/DC power converter outputs a corresponding DC voltage for powering a light source. For example, the light source can be one or more LEDs. The typical lighting system can also include a dimmer which connects between the AC input voltage and the rectifier and provides dimming capability by chopping the AC input voltage. Typically, the detection method for the dimming mode is sampling of the bus voltage. When a continuous fast rising edge in the bus voltage is detected, the dimming mode is configured as a leading edge dimming mode. When a continuous fast falling edge in the bus voltage is detected, the dimming mode is configured as a trailing edge dimming mode. If there is neither a continuous fast rising edge nor a continuous fast falling edge in the bus voltage, the dimming mode is configured as a non-dimming mode.

Referring now to FIG. 1, shown is a waveform diagram of an example operation of the lighting system with a trailing edge dimmer. In this example, when the lighting system operates at the trailing edge dimming mode, the bus voltage may not immediately become zero when the trailing edge dimmer is performed, so the trailing edge dimmer may not be turned off immediately until the bus voltage drops to zero. Therefore, the detection method for the leading edge dimming mode may be inaccurate by detecting the rapid falling edge in the bus voltage when the leading edge dimmer operates. When a conduction angle of the trailing edge dimmer is relatively large, the falling edge of the bus voltage is relatively slow; that is, the falling slope is small, and the fast falling edge cannot be detected. In this way, the lighting system can trigger the non-dimming mode by mistake, resulting in error control of the bleeder circuit.

Particular embodiments provide a dimming mode detection circuit for an LED lighting system. The LED lighting system can receive alternating current input voltage Vac, and can generate a bus voltage to drive an LED load. The dimming mode detection circuit can include a leading trailing edge detection circuit to generate a leading edge detection signal to determine whether the LED lighting system operates in a leading edge dimming mode, and a trailing edge detection circuit to generate a trailing edge detection signal in accordance with a time length of a first interval of a first voltage representative of the bus voltage during two adjacent sine half-wave cycles, in order to determine whether the LED lighting system operates in a trailing edge dimming mode.

In addition, starting and end points of the first interval can be within two adjacent sine half-wave cycles. Further, when the leading edge detection signal is active, the LED lighting system may operate in the leading edge dimming mode. Also, when the time length of the first interval is greater than a first reference time during N (e.g., N is a positive integer) consecutive sine half-wave cycles and a first voltage does not have a fast rising edge, the LED lighting system may operate in the trailing edge dimming mode. In addition, when the time length of the first interval is greater than a first reference time during N consecutive sine half-wave cycles and the first voltage does not have a fast rising edge, the trailing edge detection signal can be active, and the LED lighting system may operate in the trailing edge dimming mode when the trailing edge detection signal is active and the leading edge detection signal is inactive.

In addition, when the LED lighting system neither operates in the leading edge dimming mode, nor in the trailing edge dimming mode, the LED lighting system may operate in a non-dimming mode. Also, when the trailing edge detection signal and the leading edge detection signal are detected to be inactive during N consecutive sine half-wave cycles, the LED lighting system may operate in a non-dimming mode, where N is a positive integer. Further, a starting point of the first interval can be configured as a falling phase of the first voltage during a current sine half-wave cycle, and an end point of the first interval may be configured as a rising phase of the first voltage during a next sine half-wave cycle. Further, a voltage of the first voltage at the starting point of the first interval can be less than a voltage of the first voltage at the end point of the first interval.

In addition, if the voltages of the first voltage at the starting and end points of the first interval are both small, the difference between the time length of the first interval and the time length of the first interval in the non-dimming mode can be relatively small, and it may be difficult to distinguish between the trailing edge dimming mode and the non-dimming mode. If the voltages of the first voltage at the starting and end points of the first interval are both relatively large, the dimmer may not start to operate at the starting point of the first interval. In this case, the trailing edge dimming mode and the non-dimming mode may not be distinguished. In particular embodiments, the voltage at the of the starting point of the first interval can be smaller than the voltage of the first voltage at the end point of the first interval.

In addition, a moment when the first voltage drops to a first reference voltage during a current sine half-wave cycle is the starting point of the first interval, and a moment when the first voltage rises to a second reference voltage during a next sine half-wave period can be the end point of the first interval, where the first reference voltage is less than the second reference voltage. Further, the first reference voltage may not be less than a first time, a starting point of the first time can be a moment when the first voltage drops to the first reference voltage in a current sine half-wave cycle in an non-dimming mode, and an end point of the first time may be a moment when the first voltage rises to the second reference voltage in a next sine half-wave cycle in the non-dimming mode.

In addition, when the first voltage rises to a third reference voltage, and then rises to a fourth reference voltage rapidly during N consecutive sine half-wave cycles, the leading edge detection signal may be active, and the LED lighting system operates in the leading edge dimming mode. Further, when a second time is less than a second reference time during N consecutive sine half-wave cycles, the leading edge detection signal can be active, where the second time is configured as a time length during which the first voltage rises from the third reference voltage to the fourth reference voltage, and N is a positive integer.

Particular embodiments may provide a non-dimming mode detection circuit for the LED lighting system. The non-dimming mode detection circuit can detect a time length of a first interval of a first voltage representative of the bus voltage during two adjacent sine half-wave cycles, in order to determine whether the LED lighting system operates in a non-dimming mode. Further, starting and end points of the first interval can be within two adjacent sine half-wave cycles. In addition, the non-dimming mode detection circuit can generate a first detection signal. For example, when a time length of the first interval is not greater than a first reference time during N consecutive sine half-wave cycles, the first detection signal may be active, and the LED lighting system operates in the non-dimming mode, where N is a positive integer.

In particular embodiments, operation of the dimming mode detection circuit can include, when a continuous fast rising edge of the first voltage is detected, the LED lighting system operates in the leading edge dimming mode. In addition, when the time length of the first interval is greater than the first reference time, and the continuous fast rising edge of the first voltage cannot be detected, the LED lighting system operates in the trailing edge dimming mode. Further, when the LED lighting system neither operates in the leading edge dimming mode nor in the trailing edge dimming mode, the LED lighting system operates in non-dimming mode, such that the LED lighting system has no dimmer or the LED lighting system has a dimmer that does not work. In certain embodiments, the dimmer can be configured as a silicon-controlled dimmer. In this way, particular embodiments adopt different methods in order to determine the leading edge dimming mode and the trailing edge dimming mode. The leading edge detection circuit can detect a fast rising edge of the first voltage, in order to determine the leading edge dimming mode.

Figure 2:
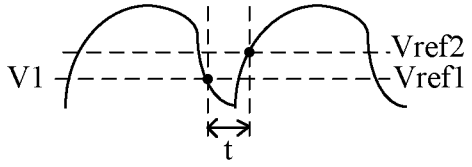
FIG. 2 is a waveform diagram of example operation of a trailing edge detection circuit, in accordance with embodiments of the preset invention.

Referring now to FIG. 2, shown is a waveform diagram of example operation of a trailing edge detection circuit, in accordance with embodiments of the preset invention. In the current sine half-wave cycle, the moment when voltage V1 drops to reference voltage Vref1 is the starting point of the first interval, and in the next sine half-wave cycle, the moment when voltage V1 rises to reference voltage Vref2 is the end point of the first interval, and the time length of the first interval is t. When time length t of the first interval is greater than the first reference time, and the leading edge detection circuit determines that the LED lighting system does not operate in the leading edge dimming mode, the LED lighting system can be determined to operate in the trailing edge dimming mode. Here, the first reference time is not less than a first time, a starting point of the first time is a moment when the first voltage drops to the first reference voltage in a current sine half-wave cycle in a non-dimming mode, and an end point of the first time is a moment when the first voltage rises to the second reference voltage in a next sine half-wave cycle in the non-dimming mode. To determine whether the LED lighting system operates in the trailing edge dimming mode, the dimming mode detection circuit can detect whether time length t of the first interval is greater than the first reference time, also detect whether the LED lighting system operates in the leading edge dimming mode, because in the leading edge dimming mode time length t of the first interval is also greater than the first reference time.

In some cases, it may not be necessary to determine whether the LED lighting system operates in the trailing edge dimming mode or the leading edge dimming mode, but only whether the LED lighting system operates in the non-dimming mode. Since the time length of the first interval can be greater than the first reference time in the trailing edge dimming mode and the leading edge dimming mode, the operating principle of the non-dimming mode detection circuit can determine the non-dimming mode based on the time length of the first interval. Further, when the time length of the first interval is greater than the first reference time, the LED lighting system may operate in the non-dimming mode. In particular embodiments, the dimming mode detection circuit can adopt different methods to detect the leading edge dimming mode and the trailing edge dimming mode, can accurately distinguish three different modes of the dimmer, and may improve the compatibility of the LED lighting system for the dimmer and the detection accuracy of the trailing edge dimming mode. This method can substantially avoid the problem of triggering the non-dimming mode by mistake, and error control of the bleeder circuit caused by factors, such as the rapid falling edge of the first voltage being not detected when the LED lighting system operates at the trailing edge dimming mode. In this way, strong versatility that is not limited by the operation method of the dimmer, accurate detection, and suitability for high-efficiency LED dimming systems can be achieved.

Figure 3:
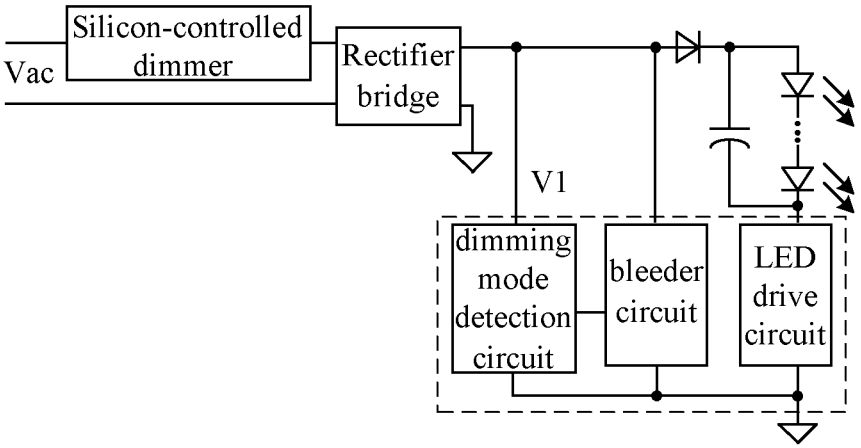
FIG. 3 is a schematic block diagram of an example LED lighting system, in accordance with embodiments of the preset invention.

Referring now to FIG. 3, shown is a schematic block diagram of an example LED lighting system, in accordance with embodiments of the preset invention. This particular example LED lighting system can include a rectifier bridge, an LED drive circuit, a dimming mode detection circuit, and a bleeder circuit. The rectifier bridge can rectify AC input voltage Vac and output a bus voltage for powering an LED load. The LED drive circuit can provide a current to the LED load. The dimming mode detection circuit can detect the dimming mode of the LED lighting system, and distinguish the operation state of a silicon-controlled dimmer in the LED lighting system. The bleeder circuit can be controlled according to the dimming mode.

In one embodiment, the dimming mode detection circuit can receive voltage V1 representative of the bus voltage, and determine the dimming mode of the LED lighting system according to voltage V1. When the dimming mode detection circuit determines that the LED lighting system operates in a leading edge dimming mode or a trailing edge dimming mode, the bleeder circuit can be controlled to provide a bleeder current required to maintain the normal operation of the silicon-controlled dimmer. When the dimming mode detection circuit determines that the LED lighting system operates in a non-dimming mode, that is, the LED lighting system has no silicon-controlled dimmer or the silicon-controlled dimmer in the LED lighting system is disabled, the bleeder circuit may not operate, in order to reduce power loss and improve efficiency. Here, voltage V1 can characterize an output voltage of the rectifier bridge, and may be, e.g., the output voltage of the rectifier bridge or its divided voltage.

Figure 4:
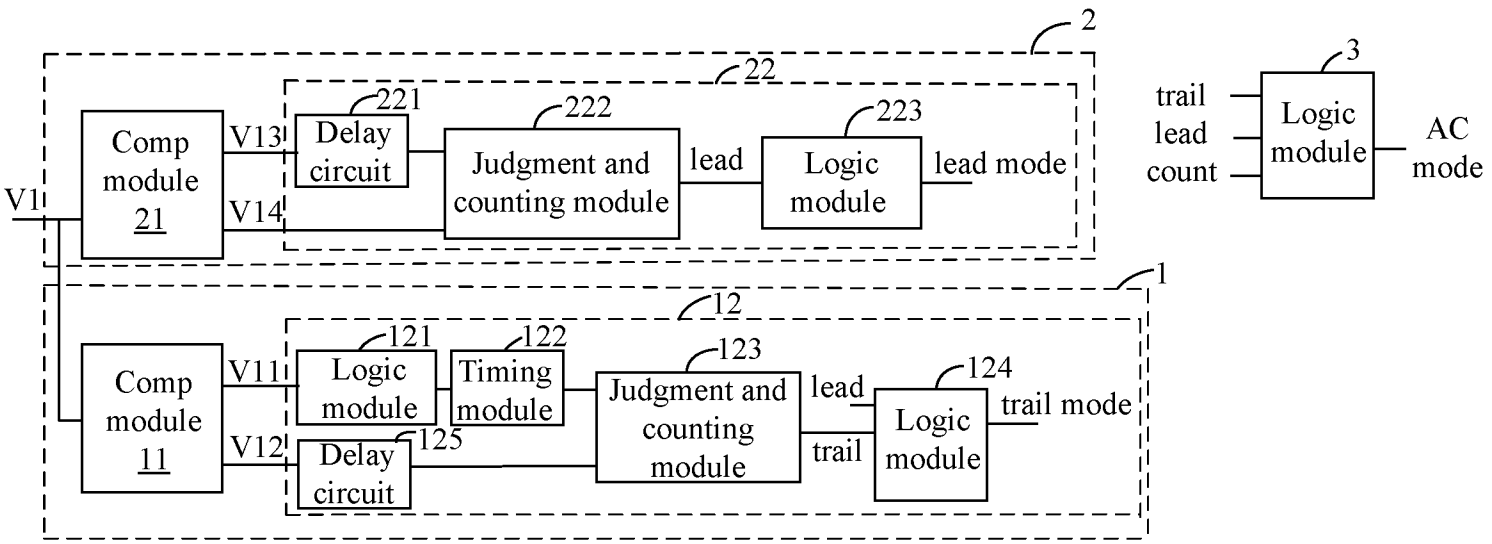
FIG. 4 is a schematic block diagram of a first example dimming mode detection circuit, in accordance with embodiments of the preset invention.

Referring now to FIG. 4, shown is a schematic block diagram of a first example dimming mode detection circuit, in accordance with embodiments of the preset invention. This example dimming mode detection circuit can include trailing edge detection circuit 1 and leading edge detection circuit 2. Trailing edge detection circuit 1 can include comparison module 11 and control module 12. Comparison module 11 can generate processed signal V11 and processed signal V12 in accordance with reference voltage Vref1, reference voltage Vref2, and voltage V1. Control module 12 can generate trailing edge detection signal 'trail' according to processed signals V11 and V12, and may generate trailing edge mode determination signal 'trail mode' according to trailing edge detection signal 'trail' and leading edge detection signal 'lead' generated by leading edge detection circuit 2. The trailing edge dimming mode of the LED lighting system can be determined by trailing mode determination signal 'trail mode'. For example, reference voltage Vref1 is less than reference voltage Vref2. In other embodiments, reference voltage Vref1 can be equal to or greater than reference voltage Vref2.

Control module 12 can include logic module 121, timing module 122, judgment and counting module 123, and logic module 124. Logic module 121 can receive processed signal V11 and generate an output signal after logic processed. Timing module 122 can receive the output signal of logic module 121, and may generate an output signal. Judgment and counting module 123 can receive the output signal of timing module 122 and processed signal V12, and may generate trailing edge detection signal 'trail'. Logic module 124 can generate trailing edge mode determination signal 'trail mode' according to trailing edge detection signal 'trail' and leading edge detection signal 'lead'. Here, the timing time of timing module 122 is the first reference time. In some cases, control module 12 can also include delay module 125. Delay module 125 can receive processed signal V12, and may output the delayed version of processed signal V12 to judgment and counting module 123. The sum of the delay time of delay module 125 and the timing time of timing module 122 is first reference time. The addition of delay module 125 can help reduce the interference of processed signal V12.

Leading edge detection circuit 2 can include comparison module 21 and control module 22. Comparison module 21 can generate processed signal V13 and processed signal V14 in accordance with reference voltage Vref3, reference voltage Vref4, and voltage V1. Control module 22 can generate leading edge detection signal 'lead' according to processed signals V13 and V14, and may generate leading edge mode determination signal 'lead mode' according to leading edge detection signal 'lead'. The leading edge dimming mode of the LED lighting system can be determined by leading edge mode determination signal 'lead mode'. Here, e.g., reference voltage Vref3 is less than reference voltage Vref4.

For example, control module 22 can include delay circuit 221, judgment and counting module 222, and logic module 223. Delay circuit 221 can receive processed signal V13, and may output a delayed version of processed signal V13. Judgment and counting module 222 can receive the delayed processed signal of V13 and processed signal V14, and may output leading edge detection signal 'lead'. Logic module 223 can receive leading edge detection signal 'lead' and output leading edge mode determination signal 'lead mode'. The delay time of delay circuit 221 is a second reference time. It should be understood that "module" as used herein can include hardware circuitry.

The dimming mode detection circuit can also include fourth logic circuit 3 for generating non-dimming mode detection signal 'AC mode' according to count signal 'count', leading edge detection signal 'lead', and trailing edge detection signal 'trail'. The non-dimming mode of the LED lighting system can be determined by non-dimming mode detection signal 'AC mode'. Here, count signal 'count' can represent the number of sine half-wave cycles that have passed. In some cases, comparison modules 11 and 12 can be the same module, in order to reduce the number of devices. In addition, reference voltage Vref1 can be equal to reference voltage Vref3, and reference voltage Vref2 may be equal to reference voltage Vref4.

Figure 5:
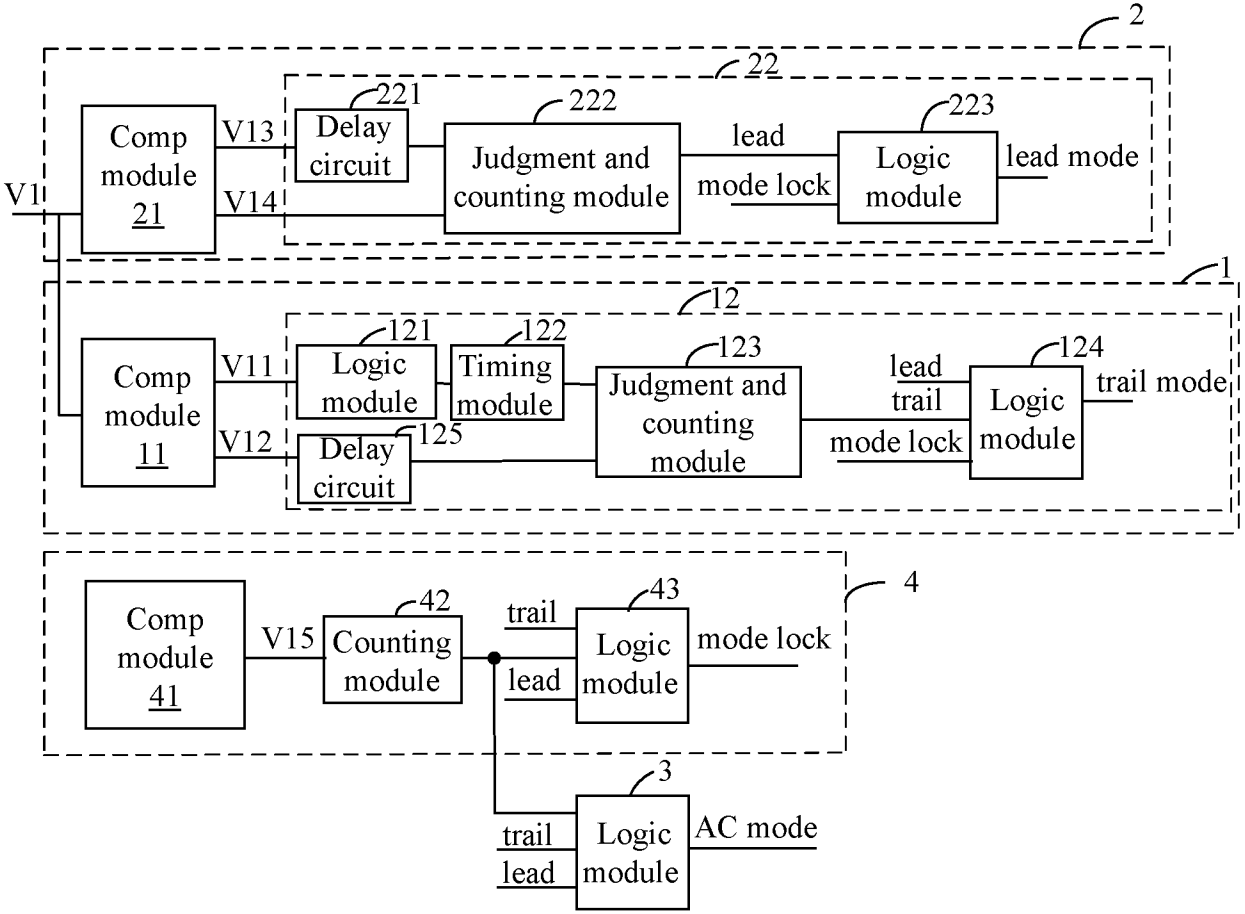
FIG. 5 is a schematic block diagram of a second example dimming mode detection circuit, in accordance with embodiments of the preset invention.

Referring now to FIG. 5, shown is a schematic block diagram of a second example dimming mode detection circuit, in accordance with embodiments of the preset invention. In this particular example, the dimming mode detection circuit can also include mode lock module 4. Mode lock module 4 can include comparison module 41, counting module 42, and logic module 43. Comparison module 41 can receive voltage V1, and may generate processed signal V15. Counting module 42 can receive processed signal V15, and may generate an output signal. Logic module 43 can receive the output signal of counting module 42, and may generate mode lock signal 'mode lock'. When the dimming mode of the LED lighting system is determined, mode lock signal 'mode lock' can be active, and mode lock module 4 can lock the detected dimming mode in the current period (e.g., leading edge dimming mode or trailing edge dimming mode or non-dimming mode), such that dimming mode detection circuit may not continue to detect the dimming mode of the LED lighting system. The addition of mode lock module 4 can prevent undesired factors, such as mains jitter, from making the detected dimming mode abnormal.

In this example, logic module 223 in leading edge detection circuit 2 can generate leading edge mode determination signal 'lead mode' according to leading edge detection signal 'lead' and mode lock signal 'mode lock'. Logic module 124 in trailing edge detection circuit 1 can generate trailing edge mode determination signal 'trail mode' according to leading edge detection signal 'lead', trailing edge detection signal 'trail', and mode lock signal 'mode lock'. Logic module 3 can generates anon-dimming mode detection signal 'AC mode' according to the output signal of counting module 42, leading edge detection signal 'lead', and trailing edge detection signal 'trail'.

Figure 6:
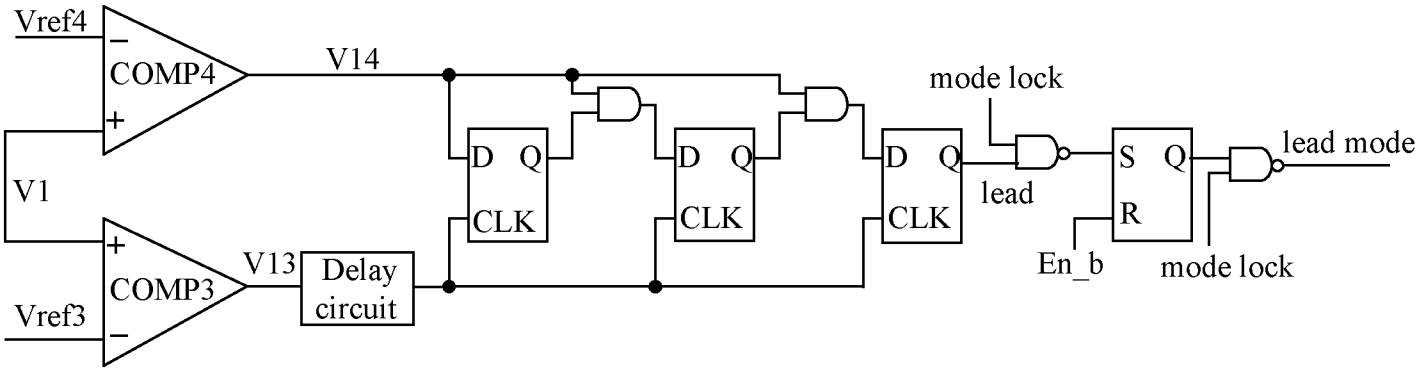
FIG. 6 is a schematic block diagram of an example leading edge detection circuit, in accordance with embodiments of the preset invention.

Referring now to FIG. 6, shown is a schematic block diagram of an example leading edge detection circuit, in accordance with embodiments of the preset invention. In this particular example, leading edge detection circuit 2 can include comparison module 21 and control module 22. Comparison module 21 can include comparators COMP3 and COMP4. Comparator COMP3 can receive voltage V1 at a non-inverting input terminal, and reference voltage Vref3 at an inverting input terminal, and may generate processed signal V13 at an output terminal. Comparator COMP4 can receive voltage V1 at a non-inverting input terminal, and reference voltage Vref4 at an inverting input terminal, and may generate processed signal V14 at an output terminal.

Judgment and counting module 222 can detect that voltage V1 has a fast rising edge during N consecutive half-wave cycles, and then may generate the active leading detection signal. In this way, the dimming mode of the LED lighting system can be determined as the leading edge dimming mode. In this particular example, N is 3. Further, since reference voltage Vref3 is less than reference voltage Vref4, comparator COMP3 can generate an active high level. When processed signal V13 is at a high level and is delayed by the reference time, processed signal V14 is already at a high level, it can be considered that the time that voltage V1 rises from reference voltage Vref3 to reference voltage Vref4 is very short, and voltage V1 exhibits a fast rising edge.

Judgment and counting module 222 can include N D flip-flops. An input terminal of the first D flip-flop can receive processed signal V14, and an input terminal of each of the remaining N−1 D flip-flops can receive a signal generated by an output signal of the previous D flip-flop being logically AND'ed with processed signal V14. Trigger terminals of the N D flip-flops may all receive the output signal of delay circuit 221, and an output signal of the last D flip-flop is leading edge detection signal 'lead'. In this particular example, judgment and counting module 222 can include three D flip-flops. When the leading edge detection circuit detects that voltage V1 may have a fast rising edge during three consecutive half-wave cycles, and leading edge detection signal 'lead' can be a high level. Logic module 223 can include an RS flip-flop. A set terminal of the RS flip-flop can receive a signal generated by leading edge detection signal 'lead' being logically NAND'ed with mode lock signal mode 'lock' by the NAND-gate, and a signal at an output terminal of the RS flip-flop can be logically NAND'ed with mode lock signal 'mode lock' by the NAND-gate, in order to generate leading edge mode determination signal 'lead mode'.

Figure 7:
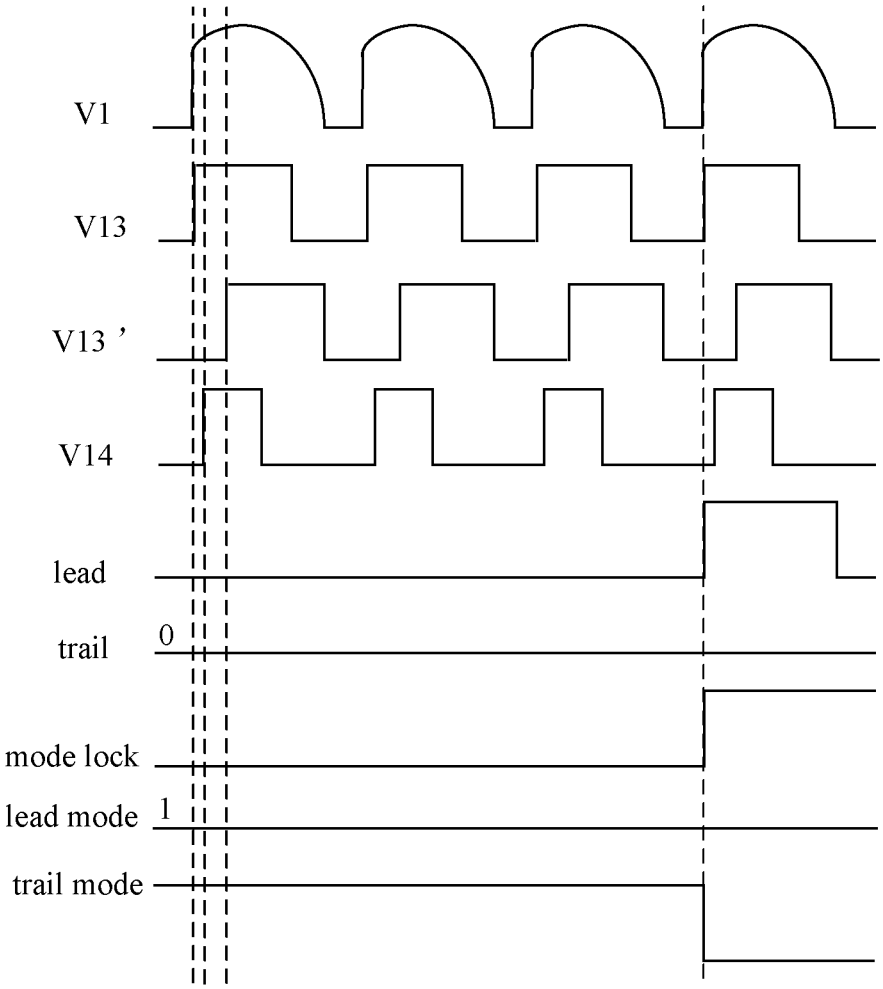
FIG. 7 is a waveform diagram of an example operation of the leading edge detection circuit in FIG. 6, in accordance with embodiments of the preset invention.

Referring now to FIG. 7, shown is a waveform diagram of an example operation of the leading edge detection circuit in FIG. 6, in accordance with embodiments of the preset invention. As shown, during each of the three consecutive sine half-wave cycles processed signal V13 is at a high level, and after the delay time (e.g., the second reference time) of the delay circuit processed signal V14 is already at a high level. That is, when delayed processed signal V13' changes from the low level to the high level processed signal V14 is already at a high level, so the leading edge detection signal 'lead' is the high level, and the mode lock signal 'mode lock' is controlled by the digital logic circuit to be high, and the leading mode determination signal 'lead mode' can be high. In this way, the LED lighting system may operate in the leading edge dimming mode, the detection for the dimming mode can be completed, the dimming mode may be locked, and the dimming mode detection circuit may not continue to detect the dimming mode of the LED lighting system.

Figure 8:
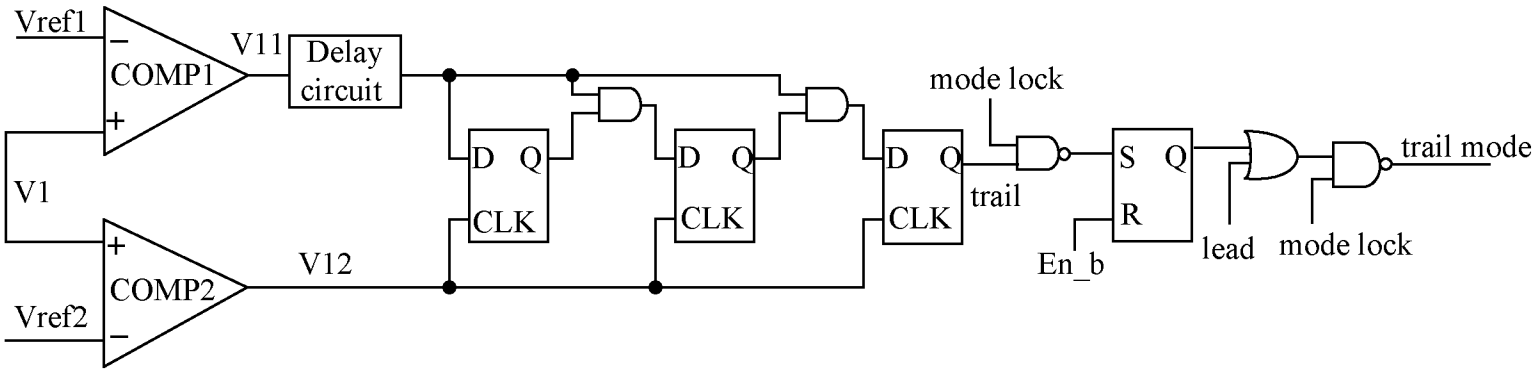
FIG. 8 is a schematic block diagram of an example trailing edge detection circuit, in accordance with embodiments of the preset invention.

Referring now to FIG. 8, shown is a schematic block diagram of an example trailing edge detection circuit, in accordance with embodiments of the preset invention. Trailing edge detection circuit 1 can include comparison module 11 and control module 12. Comparison module 11 can include comparators COMP1 and COMP2. Comparator COMP1 can receive voltage V1 at a non-inverting input terminal, and reference voltage Vref1 at an inverting input terminal, and may generate processed signal V11 at an output terminal. Comparator COMP2 can receive voltage V1 at a non-inverting input terminal, and reference voltage Vref2 at an inverting input terminal, and may generate processed signal V12 at an output terminal.

Logic module 121 can be configured as an inverter, and processed signal V11 can be inverted by the inverter, and then output to timing module 122. When judgment and counting module 123 detects that a time length of a first interval is greater than the timing time set by timing module 122 during N consecutive sine half-wave cycles, trailing edge detection signal 'trail' can be active. When the fast rising edge of voltage V1 is not detected during N consecutive sine half-wave cycles, the dimming mode of the LED lighting system can be determined as the trailing edge dimming mode, and trailing edge mode detection signal 'trail mode' can be a high level. The fast rising edge may not be detected for N (e.g., 3) half-sine cycles (e.g., the front cut detection signal lead is low), the system can be considered as operating in the rear cut dimming mode, and the trail mode judgment signal trail mode can be high. Judging and counting module 123 can include N D flip-flops. An input terminal of first D flip-flop can receive the output signal of timing module 122, and an input terminal of each of the remaining N−1 D flip-flops can receive a signal in which an output signal of the previous D flip-flop and the output signal of timing module 122 are AND'ed. Trigger terminals of the N D flip-flops may all receive processed signal V12, and an output signal of the last D flip-flop is trailing edge detection signal 'trail'.

Logic module 124 can include an RS flip-flop. A set terminal of the RS flip-flop can receive a signal after leading edge detection signal 'lead' and mode lock signal mode 'lock' pass through the NAND-gate. An OR-gate can receive an output terminal of the RS flip-flop at a first input terminal, and leading edge detection signal 'lead' at a second input terminal. An AND-gate can receive an output terminal of the OR-gate at a first input terminal, and mode lock signal 'mode lock' at a second input terminal, and may generate trailing mode determination signal 'trail mode' at an output terminal.

Figure 9:
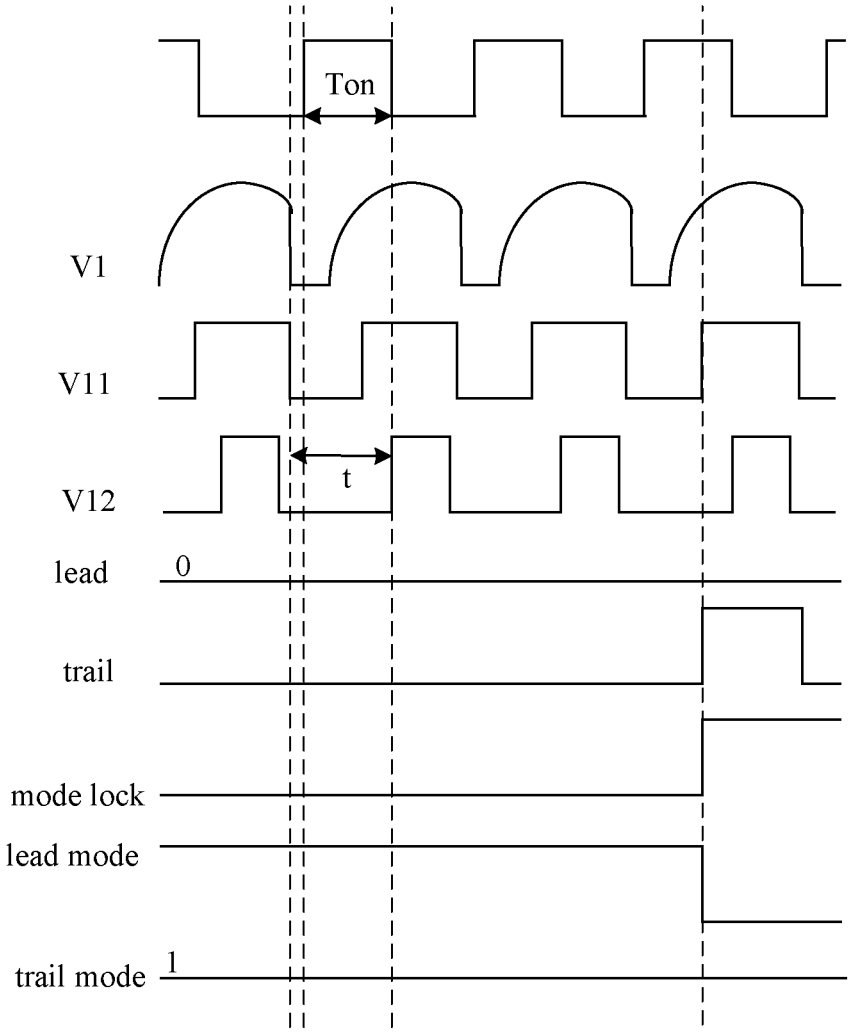
FIG. 9 is a waveform diagram of an example operation of the trailing edge detection circuit in FIG. 8, in accordance with embodiments of the preset invention.

Referring now to FIG. 9, shown is a waveform diagram of an example operation of the trailing edge detection circuit in FIG. 8, in accordance with embodiments of the preset invention. As shown, when processed signal V11 is at a low level, the input signal of timing module 122 is a high level, and timing module 122 can operate. When the time length of the first interval is greater than timing time Ton of timing module 122 during each of N consecutive cycles, that is, a time length from the moment when processed signal V11 changes from a high level to a low level to the moment when processed signal V12 changes from a low level to a high level is greater than timing time Ton (e.g., first reference time), trailing edge detection signal 'trail' can be high.

When trailing edge detection signal 'trail' is high and the leading detection signal 'lead' is low, and the mode lock signal 'mode lock' is high after being logically control by the digital logic circuit, and the trail mode determination signal 'trail mode' is high level, the LED lighting system may operate in the trailing edge dimming mode. In this way, the detection for the dimming mode can be completed, dimming mode detection can be, the dimming mode may be locked, and the dimming mode detection circuit may not continue to perform the detection for the dimming mode. As shown, timing time Ton of the timing module is the first reference time. In the non-dimming mode, timing time Ton is set to be a time length from a moment when voltage V1 drops to reference voltage Vref1 in a current sine half-wave cycle to a moment when voltage V1 rises to reference voltage Vref2 in the next sine half-wave cycle.

Figure 10:
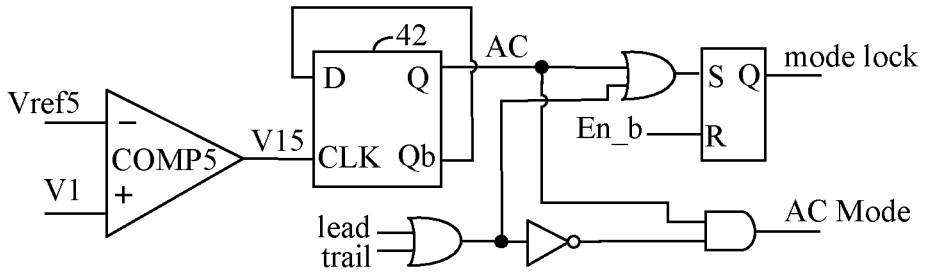
FIG. 10 is a schematic block diagram of an example mode lock module and an example fourth logic module, in accordance with embodiments of the preset invention.

Referring now to FIG. 10, shown is a schematic block diagram of an example mode lock module and an example fourth logic module, in accordance with embodiments of the preset invention. This example mode lock module can include comparison module 41, counting module 42, and logic module 43. Comparison module 41 can include comparator COMP5. Comparator COMP5 can receive voltage V1 at a non-inverting input terminal, and reference voltage Vref5 at an inverting input terminal, and may generate processed signal V15 at an output terminal. Counting module 42 can receive processed signal V15 and may generate signal 'AC'. In this example, counting module 42 can be configured as a D flip-flop. The D flip-flop can receive an inverted version of signal 'AC' at an input terminal, and processed signal V15 at a trigger terminal, and may generate signal 'AC' at an output terminal.

Logic module 43 can include an RS flip-flop. The RS flip-flop can receive a signal generated by signal 'AC' being logically OR' with trailing edge detection signal 'trail' and leading edge detection signal 'lead' at a set terminal, and enable signal En_b at a reset terminal, and may generate mode lock signal 'mode lock' at an output terminal. Logic module 3 can include a OR-gate, a NOR-gate, and an AND-gate. The NOR-gate can receive trailing edge detection signal 'trail' and leading edge detection signal 'lead' at input terminals. An input terminal of the NOR-gate can connect to an output terminal of the OR-gate. The AND-gate can receive signal 'AC' and an output signal of the NOR-gate at input terminals, and may generate non-dimming mode determination signal 'AC mode' at an output terminal.

Figure 11:
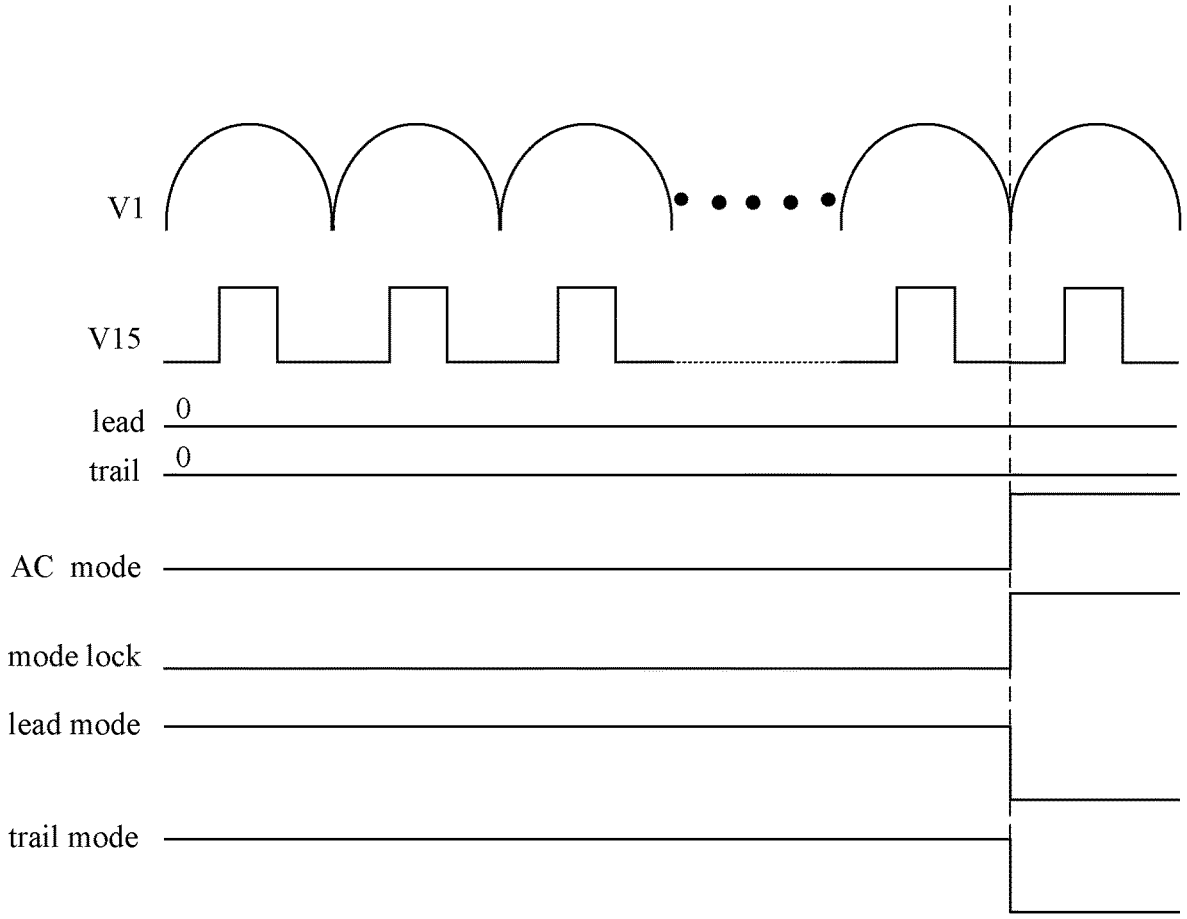
FIG. 11 is a waveform diagram of an example operation of the mode lock module and the fourth logic module in FIG. 10, in accordance with embodiments of the preset invention.

Referring now to FIG. 11, shown is a waveform diagram of an example operation of the mode lock module and the fourth logic module in FIG. 10, in accordance with embodiments of the preset invention. As shown, when voltage V1 is greater than reference voltage Vref5, processed signal V15 is at a high level, and counting module 42 can be triggered. When processed signal V15 has a high level during each of M continuous sine half-wave cycles, that is, input voltage Vac may be provided for the LED lighting system during M continuous sine half-wave cycles, and output signal 'AC' of counting module 42 is a high level.

When leading edge detection signal 'trail' and leading edge detection signal 'lead' are both low levels, non-dimming mode determination signal 'AC mode' is a high level, and the LED lighting system can be determined to operate in the non-dimming mode. In this way, the detection for the dimming mode may be completed, and the dimming mode can be locked, in order to avoid abnormality of the system due to, e.g., mains jitter. In addition the dimming mode detection circuit may not continue to perform the detection for the dimming mode. In one embodiment, the number M of consecutive sine half-wave cycles to be detected in the non-dimming mode is greater than the number N of consecutive sine half-wave cycles to be detected in the trailing dimming mode and the leading dimming mode. That is, M is a positive integer that is greater than positive integer N.

In order to reduce the number of components, comparison modules 11, 21, and 41 can be combined into one comparison module in some cases. In addition, the dimming mode detection circuit may only need two comparators in some cases. Also for example, reference voltage Vref1 can be equal to reference voltage Vref3, and reference voltages Vref2, Vref4, and Vref5 can be equal. As another example, processing signals V11 and V13 can essentially be the same signal, and processing signals V12, V14, and V15 can essentially be the same signal.

Figure 12:
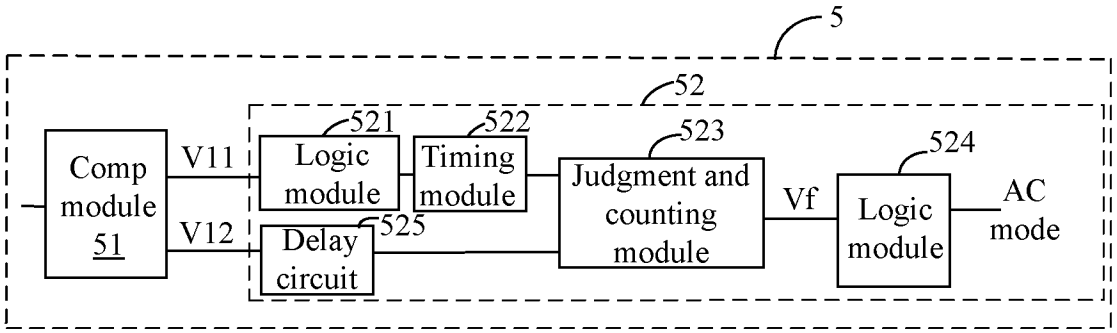
FIG. 12 is a schematic block diagram of an example non-dimming mode detection circuit, in accordance with embodiments of the preset invention.

Referring now to FIG. 12, shown is a schematic block diagram of an example non-dimming mode detection circuit, in accordance with embodiments of the preset invention. This example non-dimming mode detection circuit can include comparison module 51 and control module 52. Comparison module 51 can generate processed signals V11 and V12 according to reference voltages Vref1 and Vref2, and voltage V1. Control module 52 can generate detection signal Vf according to processed signals V11 and V12, and may generate non-dimming mode detection signal 'AC mode' according to detection signal Vf. The non-dimming mode of the LED lighting system can be determined by non-dimming mode detection signal 'AC mode'. Here for example, reference voltage Vref1 is less than reference voltage Vref2. In other examples, reference voltage Vref1 can be equal to or greater than reference voltage Vref2.

Control module 52 can include logic module 521, timing module 522, judgment and counting module 523, and logic module 524. Logic module 521 can receive processed signal V11, and may generate an output signal. Timing module 522 can receive the output signal of logic module 521, and may generate an output signal. Judgment and counting module 523 can receive the output signal of timing module 522 and processed signal V12, and may generate detection signal Vf. Logic module 524 can generate non-dimming mode detection signal 'AC mode' in accordance with detection signal Vf. Here, the timing time of timing module 522 is the first reference time.

In addition, when a time length of the first interval is detected to be not greater than a first reference time during N consecutive sine half-wave cycles, detection signal Vf can be active, and the LED lighting system may operate in the non-dimming mode, where N is a positive integer. That is, the time length from the moment when processed signal V11 changes from a high level to a low level to the moment when processed signal V12 changes from a low level to a high level may not be greater than the first reference time, detection signal Vf can be a high level, and the LED lighting system may operate in the non-dimming mode. In one embodiment, control module 52 can also include delay module 525. Delay module 525 can receive processed signal V12 and output the delayed processed signal to judgment and counting module 524. The sum of the delay time of delay module 525 and the timing time of timing module 522 is first reference time. The addition of delay module 125 can help reduce the interference of processed signal V12.

Particular embodiments may provide a dimming mode detection method for the LED lighting system. In a first step, a leading edge detection signal can be generated to determine whether the LED lighting system operates in a leading edge dimming mode. In a second step, a time length of a first interval of a first voltage representative of the bus voltage can be detected during two adjacent sine half-wave cycles, in order to determine whether the LED lighting system operates in a trailing edge dimming mode in accordance with the time length of the first interval and the leading edge detection signal. Further, starting and end points of the first interval can be within two adjacent sine half-wave cycles.

In addition, when the LED lighting system neither operates in the leading edge dimming mode, nor in the trailing edge dimming mode, the LED lighting system may operate in a non-dimming mode. Also, when the leading edge detection signal is active, the LED lighting system can operate in the leading edge dimming mode. Further, when the time length of the first interval is greater than a first reference time during each of N consecutive sine half-wave cycles and the first voltage does not have a fast rising edge, the trailing edge detection signal may be active, and the LED lighting system can operate in the trailing edge dimming mode, where N is a positive integer.

In addition, a trailing edge detection signal can be generated in accordance with the time length of the first interval. When the time length of the first interval is greater than a first reference time during each of the N consecutive sine half-wave cycles, the trailing edge detection signal can be active, and the LED lighting system may operate in the trailing edge dimming mode when the trailing edge detection signal is active and the leading edge detection signal is inactive. Also, when the trailing edge detection signal and the leading edge detection signal are detected to be inactive during N consecutive sine half-wave cycles, the LED lighting system may operate in a non-dimming mode, where N is a positive integer.

In addition, a starting point of the first interval can be configured as a falling phase of the first voltage during a current sine half-wave cycle, and an end point of the first interval may be configured as a rising phase of the first voltage during a next sine half-wave cycle. Further, a voltage of the first voltage at the starting point of the first interval may be less than a voltage of the first voltage at the end point of the first interval. Also, when a time length of the first interval is detected to be not greater than a first reference time, the LED lighting system may operate in the non-dimming mode. Further, a moment when the first voltage drops to a first reference voltage during a current sine half-wave cycle is the starting point of the first interval, and a moment when the first voltage rises to a second reference voltage during a next sine half-wave period is the end point of the first interval, where the first reference voltage is less than the second reference voltage.

In addition, when the first voltage rises to a third reference voltage, and then rises to a fourth reference voltage rapidly, the leading edge detection signal can be active, and the LED lighting system may operate in the leading edge dimming mode. Further, when a second time is less than a second reference time during N (e.g., a positive integer) consecutive half-sine cycles, the leading edge detection signal can be active, where the second time is configured as a time length during which the first voltage rises from the third reference voltage to the fourth reference voltage.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A method of controlling a light-emitting diode (LED) lighting system, the LED lighting system receiving an alternating current input voltage, and being configured to generate a bus voltage to drive an LED load, the method comprising:

a) detecting a time length of a first interval in which a first voltage representative of the bus voltage is within a preset voltage range between a moment when the first voltage drops to a first reference voltage and a moment when the first voltage rises to a second reference voltage during two adjacent sine half-wave cycles, in order to generate a trailing edge detection signal; and b) determining, by a counting module, that the LED lighting system operates in a trailing edge dimming mode when the time length of the first interval is greater than a first reference time during N consecutive sine half-wave cycles and the first voltage does not have a rising edge, wherein N is an integer greater than or equal to 1.

2. The method of claim 1, wherein starting and end points of the first interval are within two adjacent sine half-wave cycles.

3. The method of claim 1, wherein when the LED lighting system neither operates in a leading edge dimming mode, nor in the trailing edge dimming mode, the LED lighting system operates in a non-dimming mode.

4. The method of claim 1, further comprising generating a leading edge detection signal by detecting the rising edge of the first voltage using a comparison module coupled to a delay circuit, wherein the LED lighting system operates in a leading edge dimming mode when the leading edge detection signal is active.

5. The method of claim 4, wherein when the leading edge detection signal is inactive, and the trailing edge detection signal is active, the LED lighting system operates in the trailing edge dimming mode.

6. The method of claim 4, wherein when the trailing edge detection signal and the leading edge detection signal are detected to be inactive during N consecutive sine half-wave cycles, the LED lighting system operates in a non-dimming mode.

7. The method of claim 4, wherein when the first voltage rises to a third reference voltage, and then rises to a fourth reference voltage, the leading edge detection signal is active, wherein the third reference voltage is less than the fourth reference voltage.

8. The method of claim 4, wherein when a second time is less than a second reference time during N consecutive half-sine cycles, the leading edge detection signal is active, wherein the second time is configured as a time length during which the first voltage rises from a third reference voltage to a fourth reference voltage.

9. The method of claim 1, wherein a starting point of the first interval is configured as a falling phase of the first voltage during a current sine half-wave cycle, and an end point of the first interval is configured as a rising phase of the first voltage during a next sine half-wave cycle.

10. The method of claim 1, wherein a voltage of the first voltage at a starting point of the first interval is less than a voltage of the first voltage at an end point of the first interval.

11. The method of claim 1, wherein a moment when the first voltage drops to the first reference voltage during a current sine half-wave cycle is a starting point of the first interval, and a moment when the first voltage rises to the second reference voltage during a next sine half-wave period is an end point of the first interval, wherein the first reference voltage is less than the second reference voltage.

12. The method of claim 1, further comprising determining whether the LED lighting system operates in a non-dimming mode by detecting the time length of the first interval using a comparison module coupled to a timing module.

13. The method of claim 12, wherein when the time length of the first interval is detected to be not greater than the first reference time, the LED lighting system operates in the non-dimming mode.

* * * * *